US006382010B2

(12) United States Patent
Stamm

(10) Patent No.: US 6,382,010 B2
(45) Date of Patent: May 7, 2002

(54) METHOD OF PRODUCING ELONGATED FORGED ARTICLES

(75) Inventor: Detlef Stamm, Bergisch Gladbach (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 09/731,253

(22) Filed: Dec. 6, 2000

(30) Foreign Application Priority Data

Dec. 7, 1999 (DE) ..... 199 58 846

(51) Int. Cl.[7] ..... B21D 22/00; B21D 43/20; B21D 3/00

(52) U.S. Cl. ..... 72/356; 72/404; 72/405.08

(58) Field of Search ..... 72/405.08, 405.01, 72/405.09, 405.11, 405.13, 361, 356, 404

(56) References Cited

U.S. PATENT DOCUMENTS 1,896,692 A * 2/1933 Berger ..... 72/405.01
1,996,819 A * 4/1935 Dean ..... 72/405.01
3,800,583 A * 4/1974 Miller ..... 72/361
4,586,365 A * 5/1986 Henkelmann ..... 72/421

* cited by examiner

*Primary Examiner*—Daniel C. Crane
(74) *Attorney, Agent, or Firm*—Herbert Dubno

(57) ABSTRACT

A method of operating a forging press having a plurality of tool stages between which workpieces are advanced in succession. Each tool has two identical dies with a center-to-center spacing of half the stroke of a transporter for advancing the workpieces from stage to stage so that in each stage during each forging stroke of the press only one die is in contact with the workpiece while the other die is unused and in the next working stroke, the unused die engages the workpiece and the previously used die is unused. The result is a minimization of the contact time of workpieces with any given die and hence an increase in the life of the dies for a given press output or enhanced output of the press with equal or reduced die wear.

7 Claims, 2 Drawing Sheets

METHOD OF PRODUCING ELONGATED FORGED ARTICLES

FIELD OF THE INVENTION

My present invention relates to a method of producing elongated drop-forged articles and, more particularly, to a method of operating a forge for the production of such articles utilizing hot deformation in a vertical fully automatic forging press having a plurality of successive or adjacent tool stages between which the workpiece is displaced by a transfer system.

BACKGROUND OF THE INVENTION

Drop-forging processes which have dies or tools forming a multiplicity of forging stages and between which workpieces can be transported by a transport system as a rule utilize a walking beam transport or transfer system and can have these tool stages arranged in succession in a direction of stepping of the workpieces between the stages. In general, the tools are spaced within the press with a constant center-to-center distance and a single die represents each of the forging stages for graded shaping of a workpiece. In the production of drop-forged articles utilizing such presses, two modes of operation have become common. In a first mode of operation the individual tool stages are charged with a workpiece every second press stroke and each other stage remains ineffective during that stroke but receives the workpiece in the next press stroke. In this operation, a product is produced every second press stroke.

In another mode of operation, the workpieces are stages so that each stage receives a workpiece at each stroke and in that case, a product is outputted with each stroke.

Elongated articles and workpieces generally utilize rectangular dies which have relatively small widths in proportion to their length. These dies can be mounted directly adjacent one another in the die holder of the press. The shorter widths of the dies lie adjacent one another in the press. In such presses, five or six tool or die stages can be provided alongside one another.

The elongated forges can be levers, cam shafts, connecting rods and fittings widely used in the automotive field and for engines and the like. It is important that the final product be predominantly free from sharp edges, depressions or markings as can be produced if the die is provided with ejectors or the like. For that reason as well, the die cavities for such workpieces should be flush with one another where the upper and lower part of the die adjoin. It is also a common practice to fabricate such parts in pairs. For example, for crankshafts for internal combustion engines or multiple forgings in the case of fittings, two or more articles may be forged together while being interconnected in a common forging die.

The dies themselves may be fabricated with great precision by CNC machining methods and these methods and copier milling permit multiple cavity dies to be fabricated in the same time as individual cavity dies and with such precision that the die parts are flush with one another. Once these double or multiple workpieces are fabricated, they can be separated from one another by removal of the flashing between them.

The parts which are fabricated in this manner may have a relatively large surface area to weight ratio.

As a consequence, with increasing press frequencies or cadence, the heat transfer from the hot workpiece to the die can be substantial since, all other things being equal, the heat transfer from the workpiece to the die is a function firstly of the cadence of operation of the press, then the residence time of the article in contact with the die parts, the temperature drop between the workpiece and the tool and the contact area of the workpiece with the tool.

As a consequence with higher cadences, higher degrees of cooling of the die may become necessary and that, in turn, requires the forcing of greater quantities of the coolant/lubricant through the die. In the absence of the greater degree of cooling, the die may heat up excessively and that can lead to failure of the forging tool.

Of course, the use of excessive cooling lubricant can be a problem as well since the liquid may not evaporate uniformly over the entire area of the workpiece enclosed in the die. As a result the liquid may not be able to flow away and may tend to be forced out through gaps in the die. This can result in irregular shaping of the workpiece, premature damage to the die by erosion and cracking, and problems with the product.

Because of these factors, the press operations have been limited to cadences such that three to four seconds were required for each outputted product and hence relatively low production rates. Any effort to increase the output in the past has resulted in shorter die life or could be applicable only in the case of small articles with reduced surface area.

OBJECTS OF THE INVENTION

It is, therefore, the principal object of the present invention to provide an improved method of forging a workpiece or, more specifically, of operating a forge for the production of elongated articles as described whereby it is possible to operate the press with a cadence or frequency of two seconds per workpiece or less and thus a substantially higher cadence for reduced periods than has hitherto been the case and without difficulty, thereby increasing the output of the press.

Still another object of this invention is to provide a method of operating forging stages and die sets, i.e. tools, between which the workpieces are moved by a transporter, whereby drawbacks of earlier forging systems are obviated.

Still another object of the invention is to increase the output of a forging press without increasing die or tool wear or otherwise endangering the die or tool of the press.

SUMMARY OF THE INVENTION

These objects are attained, in accordance with the invention, by providing each forging stage with two identical adjacent dies or tools spaced apart by a center-to-center distance which is exactly half the transfer step of the transporter and whereby the two dies of each pair are utilized alternately and the unused die of the respective pair is thus permitted to cool until the die at the next press cycle is charged with a workpiece. Thus while each workpiece is advanced by a full step, the separation of successive die cavities by half of a full step ensures that each, by receiving a workpiece in one stroke of the press, is to be empty in the next stroke and each die which was empty at one stroke will receive a workpiece in the next stroke. As a consequence, while a workpiece is produced with each stroke of the press, at each press stroke half the dies remain unused and thus can be cooled.

A method of operating a forge according to the invention thus can comprise the steps of:

(a) providing a multiplicity of mutually adjacent forging stations for successive stages of forging of a heated elongated workpiece and a pair of substantially identical forging tools for each of said stages at a given spacing between the tools of each stage and a said given spacing of the mutually closest tools of adjacent stages;

(b) charging one of the tools of each stage with a respective workpiece so that corresponding tools of alternating stages are effective in forging said workpieces and another tool of each stage is simultaneously inoperative;

(c) advancing a new workpiece into said other tool of a first of said stages, advancing a forged article from said one tool of a last of said stages and advancing each workpiece in a stage up to said last of said stages from the one tool in each stage to the other tool of the next stage in an increment of advance equal to twice said given spacing; and (d) thereafter advancing a further new workpiece into said one tool of said first of said stages, advancing a forged article from said other tool of said last of said stages and advancing each workpiece in a stage up to said last of said stages from the other tool in each stage to the one tool of the next stage in said increment of advance.

Thus while the successive dies are spaced apart by half the transport step and the workpieces are always displaced by a full transport step between the press strokes. Each full transport step is twice the center-to-center distance of the adjacent dies.

One important feature of the invention in the operation of a forge utilizing forging dies with widths which are comparatively small with respect to their lengths and simultaneously for the successive stages in the forging and utilizing simple forging dies (single workpiece dies) as well as multiple workpiece dies is that in spite of the fact that each die is used alternately, i.e. is employed for forging at one stroke and is not employed for forging at the next stroke, is that the output of the press is not halved.

Furthermore, it is not necessary to increase the press force of the press since the unused dies at each stage do not contribute to a utilization of the press force. Furthermore, a conventional beam or lifting beam transporter of conventional design can be used for transporting the workpieces through the system.

It is only necessary to equip the lifting beam transporter with twice the number of grippers or transport clamps and to space them at the center-to-center distance between the dies.

Thus where the cycling time of the press per workpiece has been say four seconds in the past, the press of the invention can operate with a cycling time of two seconds for each workpiece which means that the heat-transfer from each workpiece to the respective die is reduced to about 50% of the heat transfer which had previously to be accommodated.

According to the invention the transport steps of the transfer system is half the center-to-center distance between successive dies along the path and each tool stage of the press (formed by a pair of dies) only receives one workpiece. In the next transfer step, the die which has previously been unused of the next tool stage then receives a workpiece and the die thereof which previously held a workpiece is emptied during the forging stroke.

According to a feature of the invention, therefore, steps (c) and (d) of the method are repeated as many times as is necessary to forge the desired number of workpieces.

The invention also includes a forge for the production of elongated articles which comprises:

a multiplicity of mutually adjacent forging stations for successive stages of forging of a heated elongated workpiece and a pair of substantially identical forging tools for each of said stages at a given spacing between the tools of each stage and a said given spacing of the mutually closest tools of adjacent stages, whereby one of the tools of each stage can be charged with a respective workpiece so that corresponding tools of alternating stages are effective in forging said workpieces and another tool of each stage is simultaneously inoperative; and a workpiece transporter engageable with said workpieces for simultaneously advancing a new workpiece into said other tool of a first of said stages, advancing a forged article from said one tool of a last of said stages and advancing each workpiece in a stage up to said last of said stages from the one tool in each stage to the other tool of the next stage in an increment of advance equal to twice said given spacing, and for thereafter simultaneously advancing a further new workpiece into said one tool of said first of said stages, advancing a forged article from said other tool of said last of said stages and advancing each workpiece in a stage up to said last of said stages from the other tool in each stage to the one tool of the next stage in said increment of advance.

The forge can be a walking or rising-beam conveyor which can be provided with grippers for engaging the workpieces.

Upstream of the first of the stages is a station for receiving new workpieces and which is configured to hold workpieces at the aforementioned given distance apart.

Each of the tools or dies is preferably configured to shape a pair of aligned elongated articles which may be automotive connecting rods.

SPECIFIC DESCRIPTION

Figure 1:
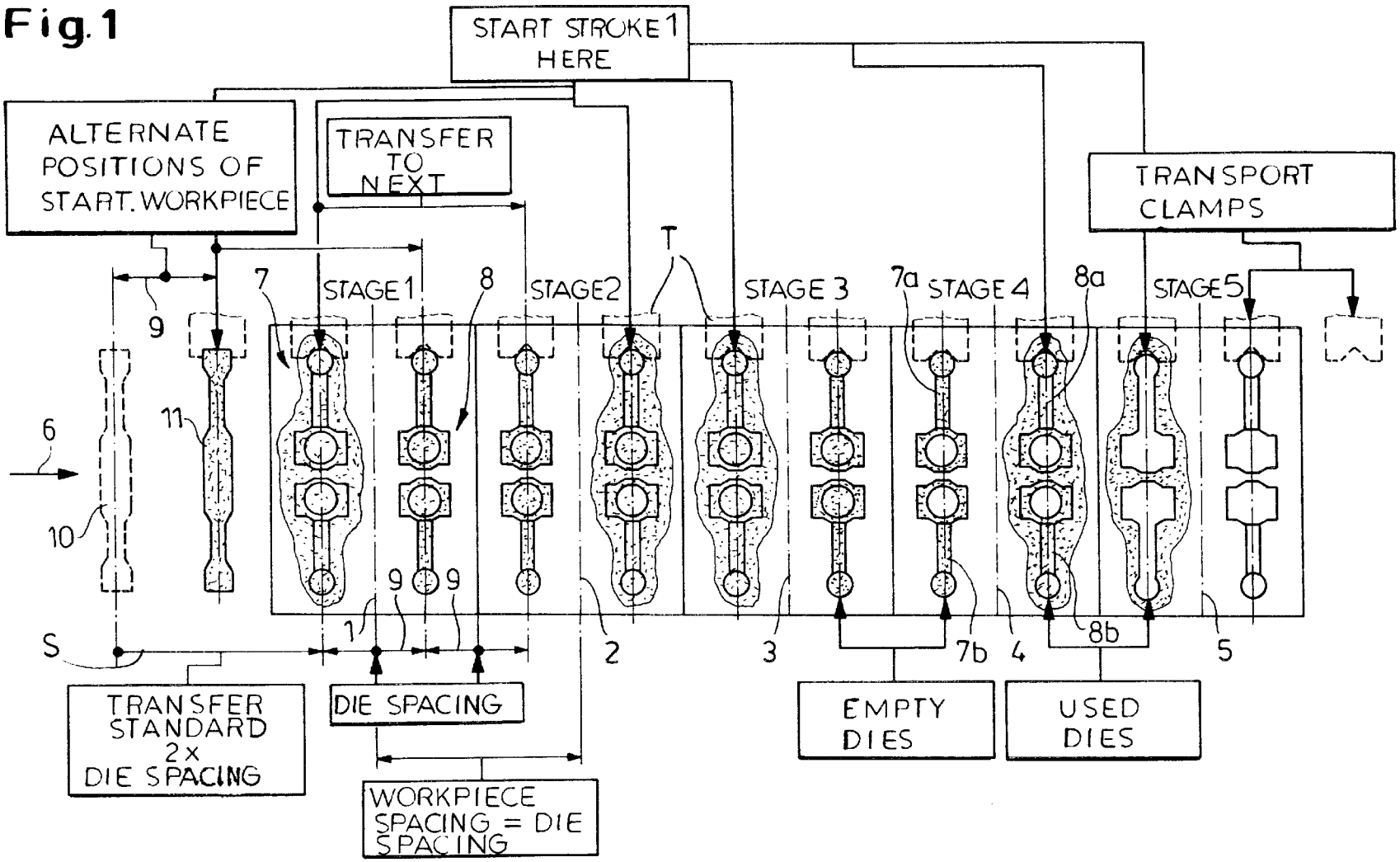
FIGS. 1 and 2 show diagrammatically a forging press having five forging stages and receiving a workpiece at the left-hand side and delivering the forged product at the right-hand side.

Only one die half is shown for each tool and it will be understood that customarily upper and lower die halves are provided on the upper and lower beams of the press and as shown in the drawing each die half may be constructed to forge two elongated members, for example, connecting rods, in an aligned position on a single workpiece with the flash between the connecting rods being subsequently removed. In addition, the stepping transporter has been shown diagrammatically and will be understood to have grippers or the like capable of seizing a workpiece, lifting it from the respective die and stepping it by a transport distance into a die of the next stage. The cavities of each die for the two connecting rods can be identical and key to the invention is the fact that the dies are narrow so that twice as many dies can be included in the press as there are forging stages with each forging stage consisting of two mutually adjacent identical dies, one of which is used for forging at each forging stroke of the press while the other is not used and the two dies of each stage are alternately used in successive forging strokes. More particularly, each tool comprises two such dies and each tool also forms a respective shaping stage.

In the drawing, structure of the press which is conventional has not been illustrated and thus the upper and lower press beams or beds and the mechanism for rising and lowering the ram have not been shown and the transporter has been indicated only by lines showing the stepping action or the grippers.

Figure 2:
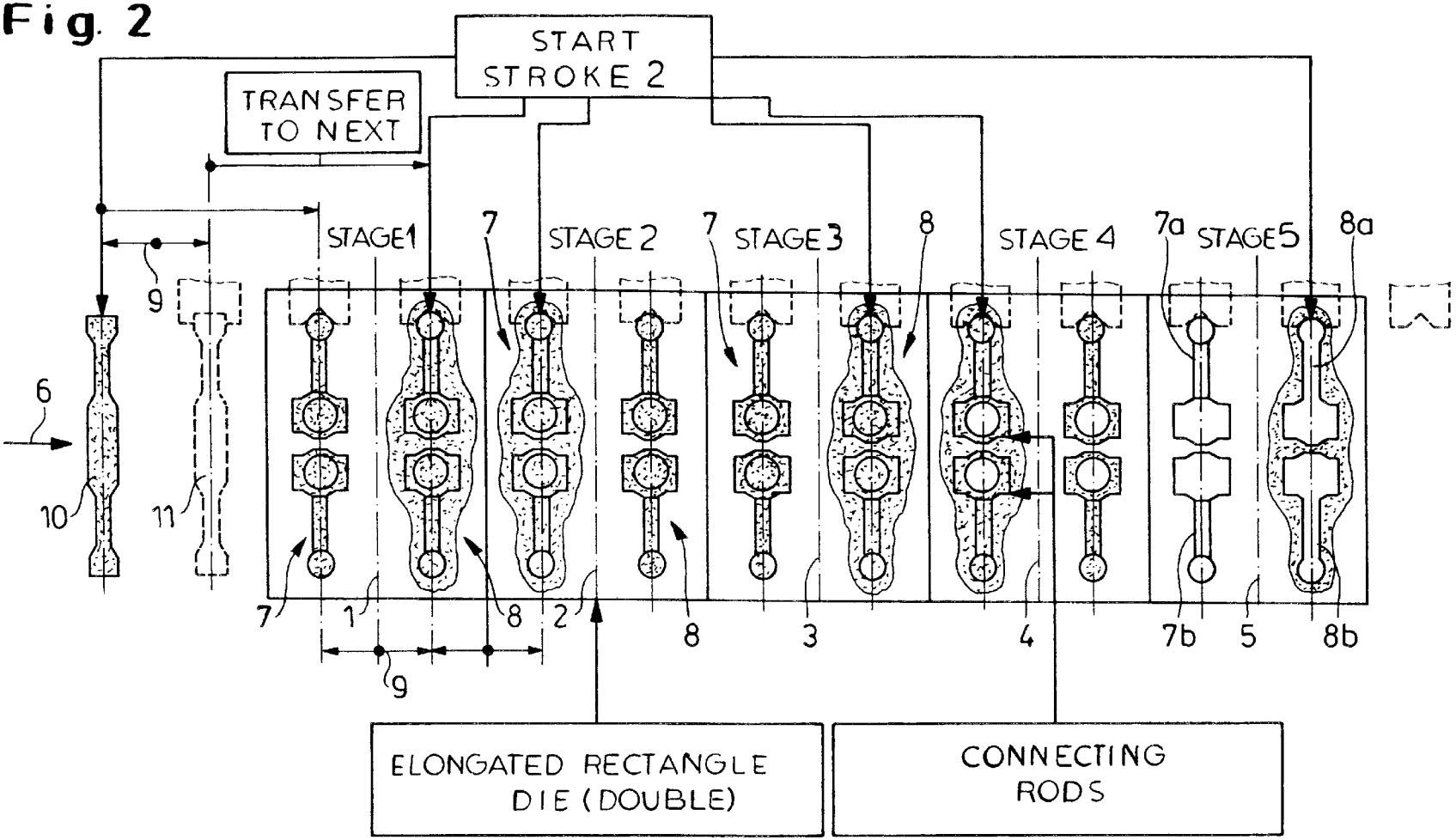

More specifically, FIGS. 1 and 2 show a drop-forging press with five tools 1–5 corresponding to the forging press stages 1, 2, 3, 4 and 5. The tools or stages 1–5 adjoin one another in the press in the transport direction represented by the arrow 6. The boundaries between individual stages have been shown by solid lines. Each tool or each forging stage 1–5 is formed with two identical dies 7 or 8 and each die is a double die as represented at 7*a,* 7*b* or 8*a,* 8*b* for each producing a pair of connecting rods in aligned orientation. The dies 7, 8 have a center-to-center distance 9 which is half of the transport step or stroke of the transporter or lifting beam system (see stroke 1 and stroke 2 in FIGS. 1 and 2). With each transfer step S, the workpiece is advanced through twice the center-to-center distance 9 of the die.

At the upstream side of the press, workpieces can be located either at the position shown at 10 or the position shown at 11 which are spaced apart by a center-to-center distance 9 corresponding to the center-to-center distance of the successive dies. In the drawing moreover, broken lines separate the dies of each tool or stage and the grippers of the transporter have been represented at T.

In a first forge stroke of the press, following the prior press operations and for the description of a complete press cycle, it can be assumed that the workpiece is present at position 11 and that there are workpieces in the left-hand die of stage 1, the right-hand die of stage 2, the left-hand die of stage 3, the right-hand die of stage 4 and the left-hand die of stage 5.

The transporter advances all of these workpieces. The press closes to forge the workpieces.

Upon opening of the press, the workpieces are all advanced by the distance S or twice the distance 9. The workpiece in the position 11 is introduced into the right-hand die of stage 1, the workpiece in the left-hand die of stage 1 is advanced to the previously empty left-hand die of stage 2, the workpiece from the right-hand die of stage 2 is placed in the right-hand die of stage 3 which was previously empty, the workpiece for the left-hand die of stage 3 is placed in the left-hand die of stage 4 which was previously empty, the workpiece from the right-hand die of stage 4 is placed in the previously empty right-hand die of stage 5 and the finished workpiece from the left-hand die of stage 5 is carried out of the press.

The press can then be closed and contains workpieces as shown in FIG. 2, a new workpiece being supplied to position 10 upstream of the press.

When the press opens again, the transporter again steps all of the workpieces by a distance S equal to twice the center-to-center distance 9. In this even stage, the workpiece in the position 10 is introduced into the left-hand position of stage 1 which was previously unused. The workpiece from the right-hand die of stage 1 is transferred to the right-hand die of stage 2, the workpiece from the left-hand die of stage 2 is transferred to the left-hand die of stage 3, the workpiece from the right-hand die of stage 3 is transferred to the right-hand die of stage 4, the workpiece from the left-hand die of stage 4 is transferred to the left-hand die of stage 5 and the workpiece from the right-hand die of stage 5 is carried out of the press as the forged article. The position shown in FIG. 1 is thereby restored and FIG. 1 can be considered to represent the odd numbered strokes, while FIG. 2 represents the even numbered strokes and the odd-numbered and an even-numbered stroke together represent a complete press cycle.

As a consequence, with each press stroke and each stroke of the transporter, a workpiece is transferred from its station outside the press, which has two positions spaced apart by the center-to-center spacing of the die, into the press and onto a die which has previously not been used for the forge action while each die which has been used for a forging action is emptied and the workpiece moved to dies which were previously unused. In the next stroke, the transfer again is to dies which were unused in the previous stroke and at each stroke a forged workpiece is discharged. Strokes 1 and 2 can represent the odd and even strokes and alternate with one another.

For a five-stage press, therefore, the pressing forces with the press of the invention is the same as that which is required where the workpieces are stepped from the die of one stage to the die of the next with each stroke in the prior art, and the press loading is likewise the same, but since each die is used only half the time, the tool life is increased. The coolant flow can remain the same as in the prior art press so that the degree of cooling can be enhanced, but can also be reduced to the level of a press operating at half the frequency as has also been described with reference to the prior art previously since the dies are utilized alternately for the press stroke. Of greatest importance however, is that since each die is in contact with a workpiece for only half the time of previous presses, the duration of operation to a given degree of wear is twice as long as with conventional presses so that the press and its part have a greatly enhanced useful life. For similarly dimensioned presses, the output is substantially increased.

I claim:

1. A forge for the production of elongated articles comprising:

a multiplicity of mutually adjacent forging stations for successive stages of forging of a heated elongated workpiece and a pair of substantially identical forging tools for each of said stages at a given spacing between the tools of each stage and a said given spacing of the mutually closest tools of adjacent stages, whereby one of the tools of each stage can be charged with a respective workpiece so that corresponding tools of alternating stages are effective in forging said workpieces and another tool of each stage is simultaneously inoperative; and a workpiece transporter engageable with said workpieces for simultaneously advancing a new workpiece into said other tool of a first of said stages, advancing a forged article from said one tool of a last of said stages and advancing each workpiece in a stage up to said last of said stages from the one tool in each stage to the other tool of the next stage in an increment of advance equal to twice said given spacing, and for thereafter simultaneously advancing a further new workpiece into said one tool of said first of said stages, advancing a forged article from said other tool of said last of said stages and advancing each workpiece in a stage up to said last of said stages from the other tool in each stage to the one tool of the next stage in said increment of advance.

2. The forge defined in claim 1 wherein said transporter is a walking-beam conveyor.

3. The forge defined in claim 1, further comprising a station upstream of said first of said stages for receiving new workpieces, said station being configured to hold workpieces at said given distance apart.

4. The forge defined in claim 3 wherein each of said tools is configured to shape a pair of aligned elongated articles.

5. The forge defined in claim 4 wherein said articles are automotive connecting rods.

6. A method of operating a forge for the production of elongated articles, comprising the steps of:

(a) providing a multiplicity of mutually adjacent forging stations for successive stages of forging of a heated elongated workpiece and a pair of substantially identical forging tools for each of said stages at a given spacing between the tools of each stage and a said given spacing of the mutually closest tools of adjacent stages;

(b) charging one of the tools of each stage with a respective workpiece and forging the respective workpiece in said one of the tools of each stage so that corresponding tools of alternating stages are effective in forging said workpieces and another tool of each stage is simultaneously inoperative;

(c) advancing a new workpiece into said other tool of a first of said stages and forging the new workpieces in the other tool of the first of the stages, advancing a forged article from said one tool of a last of said stages and advancing each workpiece in a stage up to said last of said stages from the one tool in each stage to the other tool of the next stage in an increment of advance equal to twice said given spacing and forging each workpiece in the respective other tool; and (d) thereafter advancing a further new workpiece into said one tool of said first of said stages, advancing a forged article from said other tool of said last of said stages and advancing each workpiece in a stage up to said last of said stages from the other tool in each stage to the one tool of the next stage in said increment of advance and forging the respective workpieces in the respective said one tool.

7. The method defined in claim 6 wherein steps (c) and (d) are repeated.

* * * * *